US009085870B2

(12) United States Patent
Kim

(10) Patent No.: US 9,085,870 B2
(45) Date of Patent: Jul. 21, 2015

(54) SWING CONTROL APPARATUS AND SWING CONTROL METHOD FOR CONSTRUCTION MACHINERY

(75) Inventor: Ki Yong Kim, Gyeonggi-do (KR)

(73) Assignee: Doosan Infracore Co., Ltd., Incheon (KR)

( * ) Notice: Subject to any disclaimer, the term of this patent is extended or adjusted under 35 U.S.C. 154(b) by 757 days.

(21) Appl. No.: 13/375,892

(22) PCT Filed: Jun. 1, 2010

(86) PCT No.: PCT/KR2010/003503

§ 371 (c)(1),
(2), (4) Date: Dec. 2, 2011

(87) PCT Pub. No.: WO2010/140815

PCT Pub. Date: Dec. 9, 2010

(65) Prior Publication Data

US 2012/0090309 A1 Apr. 19, 2012

(30) Foreign Application Priority Data

Jun. 2, 2009 (KR) ..... 10-2009-0048634

(51) Int. Cl.
*F16D 31/02* (2006.01)
*E02F 9/12* (2006.01)
(Continued)

(52) U.S. Cl.
CPC ..... *E02F 9/123* (2013.01); *E02F 9/128* (2013.01); *E02F 9/2025* (2013.01); *E02F 9/226* (2013.01);
(Continued)

(58) Field of Classification Search
CPC ..... E02F 9/2296; E02F 9/2217; E02F 9/2242; E02F 9/2004; E02F 9/2235; F15B 2211/20553; F15B 2211/20546; F15B 2211/6652; F16H 1/433; F16D 31/02
USPC ..... 60/445, 452
See application file for complete search history.

(56) References Cited

U.S. PATENT DOCUMENTS 7,392,653 B2 * 7/2008 Sugano ..... 60/452
2009/0229261 A1 * 9/2009 Lin et al. ..... 60/422

FOREIGN PATENT DOCUMENTS

CN 1670316 A 9/2005
CN 1950575 A 4/2007
(Continued)

OTHER PUBLICATIONS

Search Report dated Dec. 28, 2010, written in Korean for International Application No. PCT/KR2010/003503, filed Jun. 1, 2010, pp. 1-3.

(Continued)

*Primary Examiner* — Edward Look
*Assistant Examiner* — Jason Mikus
(74) *Attorney, Agent, or Firm* — John D. Veldhuis-Kroeze; Westman, Champlin & Koehler, P.A.

(57) ABSTRACT

Disclosed is a swing control apparatus of construction machinery, including: a hydraulic pump discharging working oil for driving a swing motor and controlling a discharge flux according to an input pump command value Vpump; a pressure sensor sensing pressure of the working oil discharged from the hydraulic pump; and a control unit calculating the pump command value Vpump based on a swing operation quantity Vsw input from the swing operation unit to output the calculated pump command value to the hydraulic pump, wherein when the input swing operation quantity Vsw is larger than a preset reference swing operation quantity Vswo and the discharge pressure Ppump of the hydraulic pump detected by the pressure sensor is lower than a first reference pressure Pswr1, the control unit calculates a converted swing operation quantity Vsw' gradually increasing from the reference swing operation quantity Vswo to the input swing operation quantity Vsw and calculates the pump command value Vpump of the hydraulic pump corresponding to the converted swing operation quantity Vsw'.

4 Claims, 7 Drawing Sheets

(51) Int. Cl.
*E02F 9/20* (2006.01)
*E02F 9/22* (2006.01)

(52) U.S. Cl.
CPC ..... *E02F 9/2207* (2013.01); *E02F 9/2235* (2013.01); *E02F 9/2285* (2013.01); *E02F 9/2296* (2013.01)

(56) References Cited

FOREIGN PATENT DOCUMENTS

| | | | |
|---|---|---|---|
| CN | 101057044 | A | 10/2007 |
| JP | 2003-206903 | A | 7/2003 |
| JP | 2003206903 | A | 7/2003 |
| JP | 2005265002 | A | 9/2005 |
| JP | 2007-247731 | A | 9/2007 |
| JP | 2007247731 | A | 9/2007 |
| KR | 10-0185429 | B1 | 4/1999 |
| KR | 0185429 | | 4/1999 |

OTHER PUBLICATIONS

Chinese Office Action dated Apr. 3, 2014 for corresponding Chinese Application No. 201080024521.0, 5 pages.

Chinese Office Action dated Nov. 26, 2014 for corresponding Chinese Application No. 201080024521.0, 6 pages.

* cited by examiner

SWING CONTROL APPARATUS AND SWING CONTROL METHOD FOR CONSTRUCTION MACHINERY

This application is a Section 371 National Stage Application of International Application No. PCT/KR2010/003503, filed Jun. 1, 2010 and published, not in English, as WO2010/140815 on Dec. 9, 2010.

FIELD OF THE DISCLOSURE

The present disclosure relates to construction machinery including a relatively swingable top swing body to a body, and particularly, to a swing control apparatus and a swing control method for construction machinery capable of minimizing a loss of power due to swing inertia caused by a sudden swing operation of a driver.

BACKGROUND OF THE DISCLOSURE

In hydraulic construction machinery such as an excavator, working machines and a top swing body are operated by working oil discharged from a pump operated by an engine. In more detail, a flow direction of the working oil discharged from the pump is controlled by a control valve switched according to a signal pressure generated from an operation unit and thus, the working oil is supplied to each working machine and a swing motor. The working machines and the top swing body are operated by the supplied working oil.

In this case, when a swing operation quantity is increased in order to suddenly rotate the top swing body through an operation of a swing operation unit, a swash plate of a hydraulic pump is controlled so as to discharge a flux corresponding to a swing operation quantity. As a result, a considerable flux is discharged from the hydraulic pump. However, the top swing body has a large rotational inertia and therefore, a swing speed thereof is not suddenly increased in proportion to the flux discharged from the hydraulic pump but is slowly increased. Therefore, the whole flux discharged from the hydraulic pump cannot be used for the driving of the swing motor, such that the pressure of the working oil is increased and the pressure of the increased working oil exceeds pressure of a swing relief.

In this case, hydraulic parts may be damaged and most flux discharged from the hydraulic pump at the early stage of swinging is discharged to a tank through a swing relief valve to increase a loss of power.

The discussion above is merely provided for general background information and is not intended to be used as an aid in determining the scope of the claimed subject matter.

SUMMARY

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The present disclosure has been made in an effort to provide a swing control apparatus and a swing control method of construction machinery capable of minimizing a loss of power by effectively controlling a discharge flux from a hydraulic pump even though a sudden swing driving signal is input.

In order to achieve the object, a swing control apparatus of construction machinery includes a hydraulic pump 100 discharging working oil for driving a swing motor 120 and controlling a discharge flux according to an input pump command value Vpump; a pressure sensor 102 sensing pressure of the working oil discharged from the hydraulic pump 100; and a control unit 150 calculating the pump command value Vpump based on a swing operation quantity Vsw input from a swing operation unit 130 to output the calculated pump command value to the hydraulic pump 100, wherein when the input swing operation quantity Vsw is larger than a preset reference swing operation quantity Vswo and the discharge pressure Ppump of the hydraulic pump 100 detected by the pressure sensor 102 is lower than a first reference pressure Pswr1, the control unit 150 calculates a converted swing operation quantity Vsw' gradually increasing from the reference swing operation quantity Vswo to the input swing operation quantity Vsw and calculates the pump command value Vpump of the hydraulic pump 100 corresponding to the converted swing operation quantity Vsw', and when the input swing operation quantity Vsw is larger than the reference swing operation quantity Vswo and the discharge pressure of the hydraulic pump 100 is larger than the first reference pressure Pswr1, the control unit 150 calculates the pump command value Vpump so that the discharge pressure Pump of the hydraulic pump 100 approaches the first reference pressure Pswr1.

According to the exemplary embodiment of the present disclosure, when the input swing operation quantity Vsw is larger than the reference swing operation quantity Vswo and the discharge pressure of the hydraulic pump 100 is larger than the first reference pressure Pswr1, the control unit 150 may set the first reference pressure Pswr1 to be a target value and a difference between the first reference pressure Pswr1 and the discharge pressure Ppump of the hydraulic pump 100 to be an error value to perform a proportional and integral control and calculate a pump command value Vpump output by subtracting a subtraction command value Vpi calculated from the proportional and integral control from a pump command value Vq of the hydraulic pump 100 corresponding to the converted swing operation quantity Vsw'.

The control unit 150 may perform the proportional and integral control until the discharge pressure Ppump of the hydraulic pump 100 is below the second reference pressure Pswr2 lower than the first reference pressure Pswr1.

Meanwhile, the above-mentioned object may also be achieved by a swing control method for construction machinery including a hydraulic pump 100 discharging working oil for driving a swing motor 120 and varying a discharge flux according to a swash plate angle calculated based on an input swing operation quantity Vsw, the method including: a) comparing the discharge pressure Ppump of the hydraulic pump 100 with a first reference pressure Pswr1 when the swing operation quantity Vsw is input; b) when the discharge pressure Ppump of the hydraulic pump 100 is larger than the first reference pressure Pswr1, controlling a swash plate angle of the hydraulic pump 100 so that the discharge pressure Ppump of the hydraulic pump 100 gradually approaches the first reference pressure Pswr1; and c) when the discharge pressure Ppump of the hydraulic pump 100 is below a second reference pressure Pswr2 lower than the first reference pressure Pswr1, stopping a control at step b.

According to the exemplary embodiment, the swing control method may further include when the input swing operation quantity Vsw is larger than the reference swing operation quantity Vswo, calculating a converted swing operation quantity Vsw' gradually increasing from the reference swing operation quantity Vswo to the input swing operation quantity Vsw for a predetermined time to control the swash plate angle of the hydraulic pump 100 based on the converted swing operation quantity Vsw'.

According to Technical Solution described above, when the discharge pressure from the hydraulic pump exceeds the first reference pressure, the discharge flux of the pump can be increased while gradually reducing the discharge pressure of the hydraulic pump, such that the quantity of working oil drained through the swing relief valve can be reduced without limiting the increasing rate of the swing speed of the top swing body, thereby reducing the loss of power.

In particular, the pump command value is calculated by performing the proportional and integral control based on the discharge pressure and the first reference pressure of the hydraulic pump, thereby further reducing the loss of power.

Further, the reference ending the proportional and integral control is set to be the second reference pressure lower than the first reference pressure to end the proportional and integral control in the state in which the swing speed of the swing motor is sufficiently increased, such that the sudden increase in the discharge pressure of the hydraulic pump can be prevented even though the flux of the hydraulic pump is suddenly increased. That is, the loss of power can be further reduced.

In addition, when the input swing operation quantity is larger than the reference swing operation quantity, the pump command value is calculated based on the converted swing operation quantity that is gradually increased over time from the reference swing operation quantity to the input swing operation quantity, such that the sudden increase in the discharge pressure of the hydraulic pump can be prevented, thereby minimizing the loss of power.

DETAILED DESCRIPTION

Hereinafter, a swing control apparatus and a swing control method of construction machinery according to an exemplary embodiment of the present disclosure will be described in detail.

Figure 1:
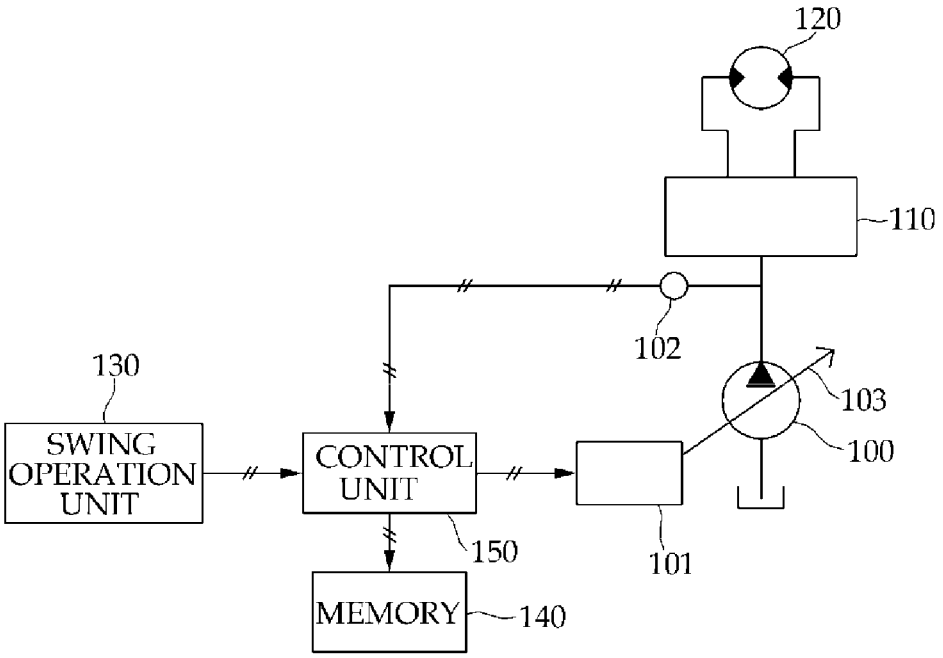
FIG. 1 is a control block diagram of a swing control apparatus according to an exemplary embodiment of the present disclosure.
Figure 2:
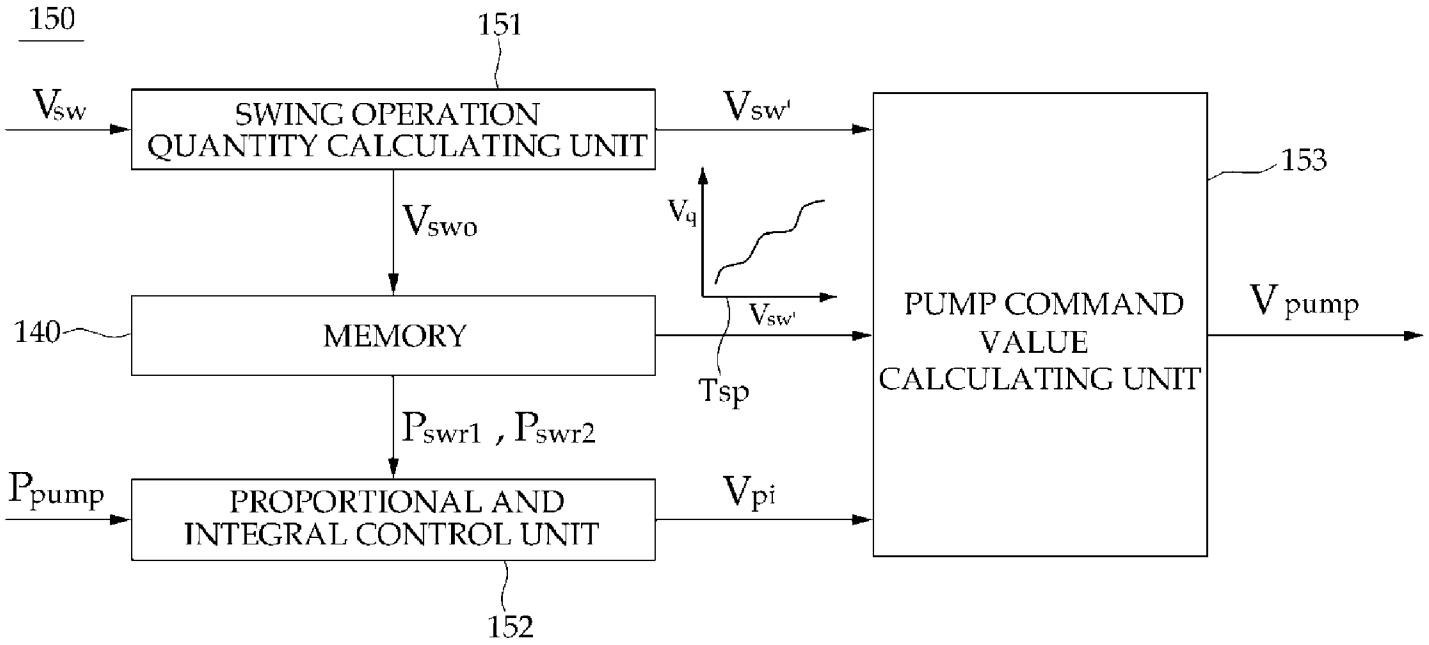
FIG. 2 is a control block diagram of a control unit of FIG. 1.

Referring to FIGS. 1 and 2, in the construction machinery according to the exemplary embodiment of the present disclosure, a flow direction of working oil discharged from a hydraulic pump 100 is controlled according to switching of a control valve 110 and the working oil is supplied to a swing motor 120. In this case, the control valve 110 controls the switching direction and the switching quantity according to the operation direction and the operation quantity that are operated from a swing operation unit 130. Therefore, the driving of the swing motor 120 is controlled by the operation of the swing operation unit 130.

Meanwhile, the hydraulic pump 100 varies the discharge flux according to a slope of a swash plate 103, wherein a slope of the swash plate 103 varies according to a pump command value Vpump input by a regulator 101.

In the construction machinery operated by the above-mentioned principle, a large quantity of flux is supplied to the swing motor 120 at the early stage of swinging so as to swing the swing motor 120 at a swing speed corresponding to a swing operation quantity Vsw when the swing operation quantity Vsw is large. However, an initial rotation speed of the swing motor 120 is very slow due to rotation inertia. In this case, most flux is not used for the driving of the swing motor 120 but suddenly increases pressure at a front end of the swing motor 120. Therefore, all the remaining flux is drained through a swing relief valve except for a small quantity of flux required to drive the swing motor 120.

For this reason, when the swing operation quantity Vsw exceeds the reference swing operation quantity Vswo, there is a need for a swing control apparatus capable of controlling the discharge flux of the hydraulic pump 100 so that the discharge quantity of the hydraulic pump 100 drained through the swing relief valve can be minimized. Hereinafter, the swing control apparatus will be described in detail.

The swing control apparatus according to the exemplary embodiment of the present disclosure includes a control unit 150 that calculates the pump command value Vpump based on the swing operation quantity Vsw input from the swing operation unit 130 and the discharge pressure Ppump detected by the pressure sensor 102 for detecting the discharge pressure of the hydraulic pump 100 to output the calculated pump command value Vpump to the regulator 101.

For convenience of understanding, the exemplary embodiment of the present disclosure shows the case in which the pressure sensor 102 is mounted between the hydraulic pump 100 and the control valve 110. However, the installation of the pressure sensor 102 is not necessarily limited thereto and when the pressure sensor 102 may measure the pressure of the working oil generated at the upstream of the swing motor 120, the pressure sensor 102 may be installed anywhere. That is, if the pressure sensor 102 is installed only at the upstream of the swing relief valve (not shown), the pressure sensor 102 may be installed anywhere and more accurately use the pressure measurement value as the pressure sensor 102 may be installed to approach the swing relief valve.

In addition, in the exemplary embodiment of the present disclosure, the present disclosure will be described by describing the most generalized system. However, the present disclosure is not necessarily used only in the system. Recently, the pump motor may be changed by an electronic scheme rather than an engine linkage scheme by commercializing an electronic hydraulic system. In this case, the pump command value Vpump may be used as a signal so as to control a swash plate angle of the pump or control an RPM of the pump motor according to a type of the pump motor. Even in the modification, the pump command value Vpump needs to be output to a size corresponding to the swing operation quantity of the user and thus, the discharge flux of the pump is controlled, which may be construed as included in the scope of the present disclosure.

Figure 3:
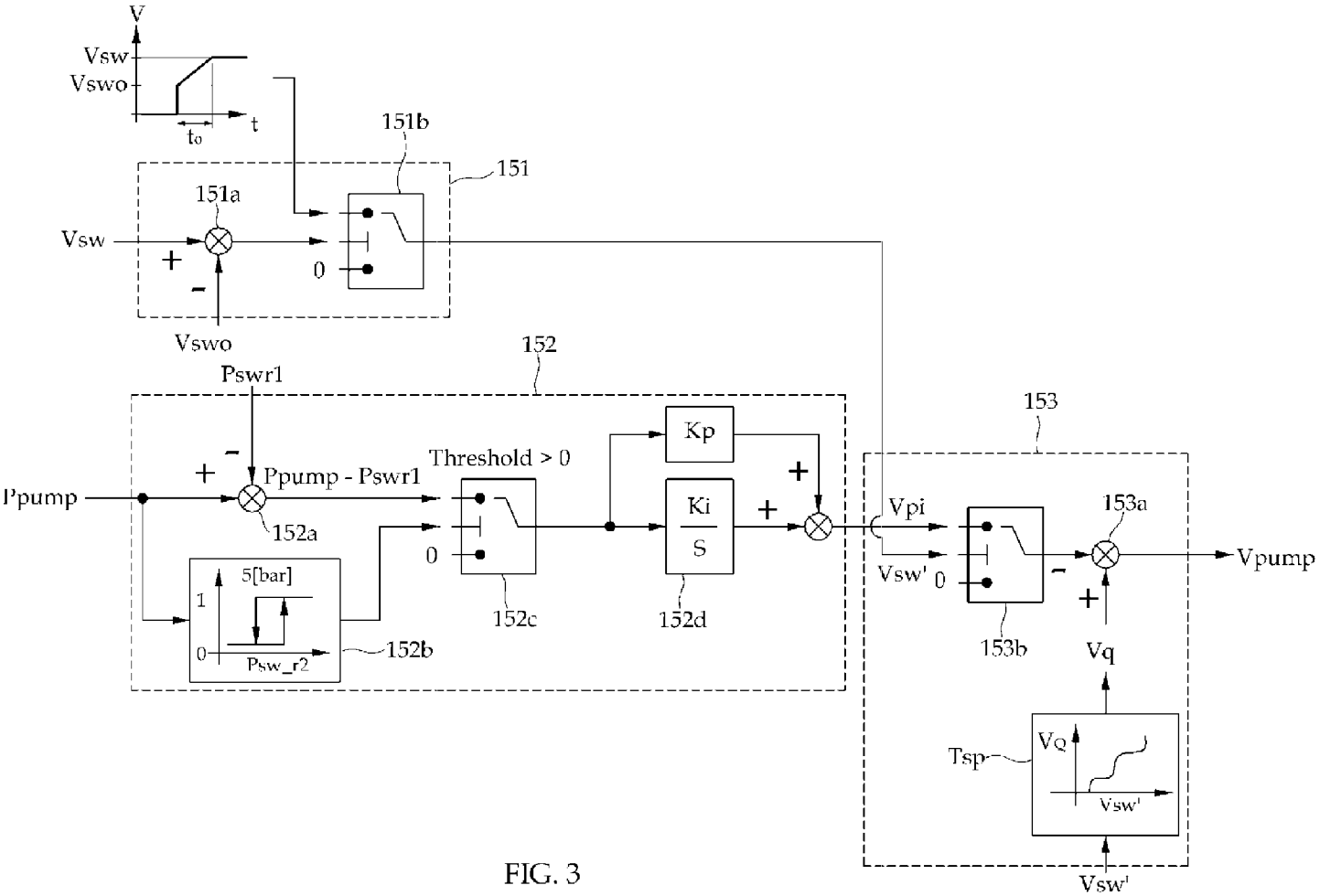
FIG. 3 is a detailed control block diagram of FIG. 2.
Figure 4:
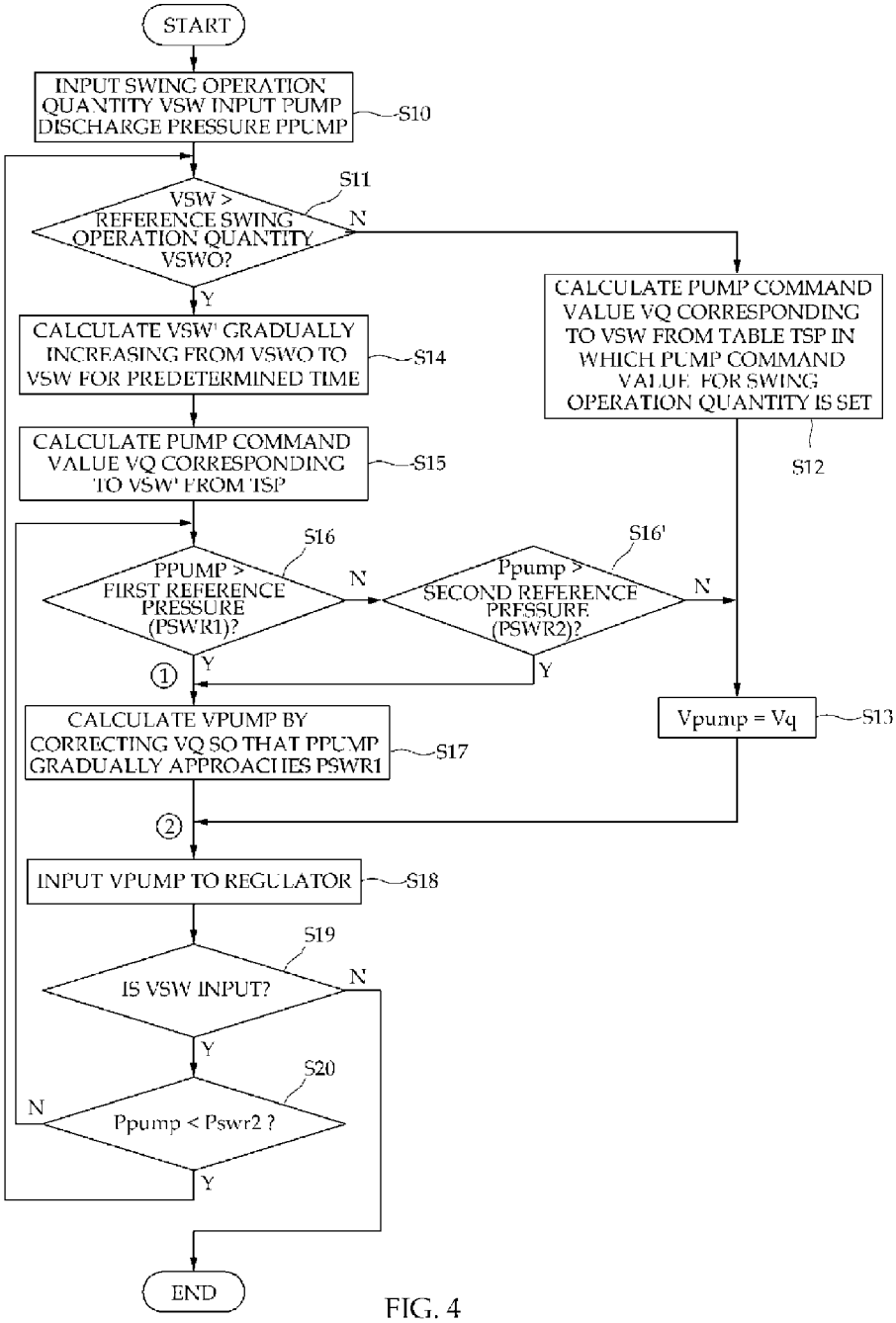
FIG. 4 is a flow chart for describing a swing control method according to an exemplary embodiment of the present disclosure.

As shown in FIGS. 2 and 3, the control unit 150 includes a swing operation quantity calculating unit 151, a proportional and integral control unit 152, and a pump command value calculating unit 153.

The swing operation quantity calculating unit 151 compares a swing operation quantity Vsw input from the swing operation unit 130 with a reference swing operation quantity Vswo and when the input swing operation quantity Vsw is smaller than the reference swing operation quantity Vswo according to the comparison results, the swing operation quantity calculating unit 151 outputs the input swing operation quantity Vsw to a pump command value calculating unit 153 as it is. Then, the pump command value calculating unit 153 calculates pump command values Vq and Vpump from a table Tsp in which a pump command value Vq for the swing operation quantity Vsw stored in a memory 140 is set and outputs the calculated pump command values to the regulator 101. As described above, the pump command value Vpump is output to the regulator 101 with respect to the pump 100 that controls the discharge flux of the pump 100 by using the regulator 101 and a control unit (not shown) for controlling the RPM of the pump with respect to the hydraulic pump 100 that controls the discharge flux of the pump by controlling the RPM of the pump motor. Herein, the pump command value Vpump is set to control the targeted pump discharge flux to correspond to the same swing operation quantity Vsw. That is, when the swing operation quantity Vsw is increased, the pump command value Vpump is output to increase the targeted discharge flux and when the swing operation quantity Vsw is reduced, the pump command value Vpump is output to reduce the targeted discharge quantity. The signal may be output to immediately respond to the swing operation so as to improve the operation efficiency. When the pump command value Vpump is output, if the input swing operation quantity Vsw is smaller than the reference swing operation quantity Vswo, there is no or little flux drained through the swing relief valve and thus, there are no problems.

However, when the swing operation quantity Vsw is larger than the reference swing operation quantity Vswo and thus, the targeted discharge flux is increased (large?), the pump command value Vpump is controlled by the swing operation quantity calculating unit 151 so that in order to minimize the flux drained through the swing relief valve in the exemplary embodiment, the pump command value Vpump is temporarily increased only to the reference swing operation quantity Vswo and then, the flux discharged from the pump for a predetermined time t0 is gradually increased to reach the targeted discharge flux. The control may be made by converting the swing operation quantity Vsw as described above and calculating the converted swing operation quantity Vsw'.

Even though the above-mentioned converted swing operation quantity Vsw' is used, the pressure of the working oil at the upstream of the swing motor 120 is temporarily increased according to the swing load, such that the flux drained through the swing relief valve may be generated. This is caused because the time t0 for calculating the converted swing operation quantity Vsw' so as to secure response of the swing driving cannot be set to be too long. To compensate for this problem, a proportional and integral control unit 152 is further used in the exemplary embodiment of the present disclosure. The proportional and integral control unit 152 in the exemplary embodiment of the present disclosure receives information on whether the current discharge pressure Ppump of the hydraulic pump 100 is larger than a first reference pressure Pswr1 and calculates the pump command values Vq and Vpump based on the information and the converted swing operation quantity Vsw'. A detailed method for calculating the pump command values Vq and Vpump will be described in detail in the description of the pump command value calculating unit 153.

A predetermined time and variation of the swing operation quantity Vsw may be represented by a graph as shown in FIG. 3 and the setting may be previously stored in the memory 140.

As shown in FIG. 3, the swing operation quantity calculating unit 151 performing the above-mentioned function may be configured to include a first summing point 151*a* summing the swing operation quantity Vsw input from the swing operation unit 130 and the reference swing operation quantity Vswo and a first switch unit 151*b* calculating the signal output to the pump command value calculating unit 153 according to the size of the swing operation quantity Vsw.

The proportional and integral control unit 152 compares the discharge pressure Ppump of the hydraulic pump 100 sensed by the pressure sensor 102 and the first reference pressure Pswr1 preset in the memory 140 and outputs, as 0, a subtraction command value Vpi to the pump command value calculating unit 153. if the discharge pressure Ppump of the hydraulic pump 100 is lower than the first reference pressure Pswr1 according to the comparison results. In this case, the subtraction command value Vpi is to subtract the pump command value Vq corresponding to the converted swing operation quantity Vsw'. When the discharge pressure Ppump of the hydraulic pump 100 is lower than the first reference pressure Pswr1, there is no working oil drained through the swing relief valve. As a result, the working oil is output to the regulator 101 without reducing the pump command value Vq.

On the other hand, according to the comparison results, when the discharge pressure Ppump of the hydraulic pump 100 is larger than the first reference pressure Pswr1, the proportional and integral control unit 152 sets the first reference pressure Pswr1 to be a target value and sets a difference value between the discharge pressure Ppump of the hydraulic pump 100 and the first reference pressure Pswr1 to be an error value to perform the proportional and integral control. When the proportional and integral control is performed, the subtraction command value Vpi is calculated. In this case, the subtraction command value Vpi is a value capable of controlling the swash plate angle of the hydraulic pump 100 so that the discharge pressure Ppump of the hydraulic pump 100 approaches the first reference pressure Pswr1, and is subtracted from the pump command value Vq. The swash plate angle of the hydraulic pump 100 may be gradually increased while preventing the discharge pressure Ppump of the hydraulic pump 100 from suddenly increasing exceeding the first reference pressure Pswr1, by the above-mentioned subtraction command value Vpi. That is, the increasing rate of the swing speed is not reduced while minimizing the flux of the working oil drained through the swing relief valve and thus, the loss of power can be minimized without reducing the response of the driving of the swinging.

The performance of the above-mentioned proportional and integral control is sustained to the state in which the discharge pressure Ppump of the hydraulic pump 100 is lower than a second reference pressure Pswr2. As described above, the discharge pressure of the hydraulic pump 100 is introduced so as to help the understanding of the exemplary embodiment of the present disclosure and is substantially referred to as the pressure at the upstream of the swing relief valve. The second reference pressure Pswr2 is set to be lower than the first reference pressure Pswr1. When the proportional and integral control ends as the discharge pressure Ppump of the hydraulic pump 100 is lower than the first reference pressure Pswr1, the pump command value Vpump corresponding to the swing operation quantity Vsw is calculated to control the swash plate 103, but in this case, the pump command value Vpump corresponding to the swing operation quantity Vsw may be larger than the first reference pressure Pswr1. In this case, the discharge pressure Ppump of the hydraulic pump 100 may be suddenly increased at higher pressure than the first reference pressure Pswr1. The above-mentioned phenomenon may repeatedly occur, such that the occurrence such as vibrations, noises, or the like, and the loss of power cannot be efficiently reduced. Therefore, the proportional and integral control ends as the discharge pressure Ppump of the hydraulic pump 100 becomes below the second reference pressure Pswr2 lower than the first reference pressure Pswr1.

In this case, the reason why the pressure is reduced during the proportional and integral control at the pressure higher than the first reference pressure Pswr1 is that the consumption of flux is increased when the driving speed of the swing motor becomes rapid. By this, when the driving speed of the swing motor becomes rapid, the pressure of the working oil is reduced and thus, the pressure may be formed at the size between the first reference pressure Pswr1 and the second reference pressure Pswr2. In this case, in order to rapidly accelerate the swing motor, the integral control is performed so as to increase the pressure in response to the first reference pressure Pswr1. In this case, the second reference pressure Pswr2 may be a point where the discharge pressure of the hydraulic pump 100 falls by the swing inertia by sufficiently increasing the swing speed. For example, when the first reference pressure Pswr1 is set to be 220 bar, the second reference pressure Pswr2 may be set to be about 215 bar. The integral control may be performed as mentioned above even when the discharge pressure is larger than the first reference pressure Pswr1 by the swing load even after the conversion of the swing operation quantity is completed. The integral control is progressed only in the case in which the swing operation quantity is larger than the reference swing operation quantity Vswo, such that the integral control may be performed only in case of necessity. This is because the increase in pressure in the case in which the swing operation quantity is not large is highly likely to be caused by a problem or a load in other driving units. In this case, when the flux control is progressed, the efficiency of the corresponding working may be reduced. That is, it is preferable to confirm the matters according to the size of the swing operation.

The proportional and integral control unit 152 performing the function may be configured to include a second summing point 152*a* to which the discharge pressure Ppump of the hydraulic pump 100 is input from the pressure sensor 102 and the first reference pressure Pswr1 is input from the memory 140, a second switch unit 152*c* determining whether to perform or end the proportional and integral control, a reference pressure selection unit 152*b* selecting the first reference pressure Pswr1 and the second reference pressure Pswr2, and a proportional and integral control performing unit 152*d* performing the proportional and integral control.

The pump command value calculating unit 153 receives the input swing operation quantity Vsw or the converted swing operation quantity Vsw' from the swing operation quantity calculating unit 151 and receives the comparison results of the subtraction command value Vpi, the discharge pressure Ppump of the hydraulic pump 100, and the first reference pressure Pswr1 from the proportional and integral control unit 152. In addition, the pump command value calculating unit 153 receives, in a table Tsp form, information on the relationship of the pump command value Vqq for the swing operation quantity Vsw stored in the memory 140.

The pump command value calculating unit 153 receiving the above-mentioned information calculates the pump command value Vpump corresponding to the converted swing operation quantity Vsw' from the table Tsp when the discharge pressure Ppump of the hydraulic pump 100 is lower than the first reference pressure Pswr1 and outputs the calculated pump command value to the regulator 101. The reason is that there is no or little quantity drained through the swing relief valve when the discharge pressure Ppump is lower than the first reference pressure Pswr1.

Meanwhile, the pump command value calculating unit 153 subtracts the subtraction command value Vpi from the calculated pump command value Vq and outputs the subtracted result to the regulator 101 when the current discharge pressure Ppump of the hydraulic pump 100 is larger than the first reference pressure Pswr1. This is to gradually increase the discharge flux for the predetermined time, because when the discharge pressure Ppump of the hydraulic pump 100 is higher than the first reference pressure Pswr1, the flux drained through the swing relief valve is increased. In this case, the swing motor 120 increases the consumed discharge flux as time lapses. Therefore, it is preferable to set the subtraction command value Vpi so as to swing the swing motor 120 at the existing acceleration while minimizing the quantity drained through the swing relief valve.

The pump command value calculating unit 153 may be configured to include a third switch unit 153*b* receiving the converted swing operation quantity Vsw' and the subtraction command value Vpi to determine whether the pump command value Vpump is subtracted and a third summing point 153*a* receiving and subtracting the subtraction command value Vpi and the pump command value Vq calculated from the table Tsp.

Hereinafter, the swing control method according to the exemplary embodiment of the present disclosure will be described. However, the control unit 150 may be differently configured from the exemplary embodiment of the present disclosure and therefore, the case in which the swing control method is integrally performed by the control unit 150 will be described by way of example.

First, when a worker operates the swing operation unit 130, the swing operation quantity Vsw input from the swing operation unit 130 and the discharge pressure Ppump of the hydraulic pump 100 from the pressure sensor 102 are input to the control unit 150 (S10). Then, the control unit 150 compares the input swing operation quantity Vsw with the preset reference swing operation quantity Vswo (S11).

As the comparison result at S11, when the input swing operation quantity Vsw is smaller than the reference swing operation quantity Vswo, the control unit 150 calculates the pump command value Vq corresponding to the swing operation quantity Vsw input from the table Tsp in which the swing operation quantity Vsw and the pump command value Vq are set (S12). In this case, the pump command value Vq may be set as a function of time that the pump command value Vq for the input swing operation quantity Vsw varies over time Thereafter, the control unit 150 outputs the calculated pump command value Vq as an output pump command value Vpump to the regulator 101 (S13) (S14). Then, the regulator 101 controls the swash plate angle of the hydraulic pump 100 according to the output pump command value Vpump to increase the flux of the hydraulic pump 100.

Thereafter, it is determined whether the swing operation quantity Vsw is input from the swing operation unit 130 (S19) and as the determination result, if it is determined that the swing operation quantity Vsw is not input, the control ends. On the other hand, at S19, when the swing operation quantity Vsw is input, it is determined whether the discharge pressure Ppump of the hydraulic pump 100 is lower than the second reference pressure Pswr2 (S20) and as the determination result, if it is determined that the discharge pressure Ppump of the hydraulic pump 100 is larger than the second reference pressure Pswr2, it is determined whether the discharge pressure Ppump of the hydraulic pump 100 is larger than the first reference pressure Pswr1 again at S16 (S16). However, since the first reference pressure Pswr1 is set as the pressure generated at the reference swing operation quantity Vswo or more, when the input swing operation quantity Vsw is smaller than the reference swing operation quantity Vswo, the discharge pressure Ppump of the hydraulic pump 100 does not exceed the first reference pressure Pswr1. Therefore, S13 is performed.

Meanwhile, as the comparison result at S11, when the input swing operation quantity Vsw is larger than the reference swing operation quantity Vswo, the control unit 150 calculates the converted swing operation quantity Vsw' gradually increasing the input swing operation quantity Vsw from the reference swing operation quantity Vswo to the input swing operation quantity Vsw for the predetermined time t0 (S14) and calculates the pump command value Vq corresponding to the converted swing operation quantity Vsw' from the table Tsp (S15). Thereafter, the control unit 150 compares the discharge pressure Ppump of the hydraulic pump 100 with the first reference pressure Pswr1 (S16). As the comparison results, when the discharge pressure Ppump of the hydraulic pump 100 is lower than or equal to the first reference pressure Pswr1, the control unit 150 outputs the calculated pump command value Vq to the regulator 101 (S13) (S18). That is, when the input swing operation quantity Vsw is larger than the reference swing operation quantity Vswo and the pump discharge pressure Ppump is lower than the first reference pressure Pswr1, since the discharge flux of the hydraulic pump 100 is not drained through the swing relief valve, the loss of flux of the working oil is not generated even though the swash plate angle is not suddenly increased. Therefore, in order improve the response of the swing operation in this situation, there is a need to suddenly increase the discharge flux. For this reason, the pump command value Vpump corresponding to the converted swing operation quantity Vsw' is output to the regulator 101. However, in this case, the flux increasing rate of the hydraulic pump 100 is set to be lower than the case in which the input swing operation quantity Vsw is smaller than the reference swing operation quantity Vswo, thereby reducing the loss due to the very sudden increase of flux.

After performing S18, the control unit 150 determines whether the swing operation quantity Vsw is input (S19) and compares the discharge pressure Ppump of the hydraulic pump 100 with the second reference pressure Pswr2 when it is determined that the swing operation quantity Vsw is continuously input. As the comparison result, when the discharge pressure Ppump of the hydraulic pump 100 is lower than the second reference pressure Pswr2, the control unit 150 performs S11 again and performs S16 when the discharge pressure Ppump of the hydraulic pump 100 is larger than the second reference pressure Pswr2. During the repetitive performance of the above-mentioned process, the discharge pressure Ppump of the hydraulic pump 100 is gradually increased to exceed the first reference pressure Pswr1. The reason is that the table Tsp is set so that the increasing rate of the discharge flux of the hydraulic pump 100 becomes larger than the increasing rate of flux required to drive the swing motor 120.

In this case, at S16, since the discharge pressure Ppump of the hydraulic pump 100 becomes larger than the first reference pressure Pswr1, when the control unit 150 is input to the pump command value Vq calculated from the converted swing operation quantity Vsw' to the regulator 101 as it is, the discharge pressure Ppump of the hydraulic pump 100 is further increased, thereby increasing the loss of power. For this reason, the control unit 150 calculates the output pump command value Vpump by correcting the calculated pump command value Vq based on the difference between the current discharge pressure Ppump of the hydraulic pump 100 and the first reference pressure Pswr1 (S17) and outputs the calculated output pump command value Vpump to the regulator 101 (S18).

Figure 5:
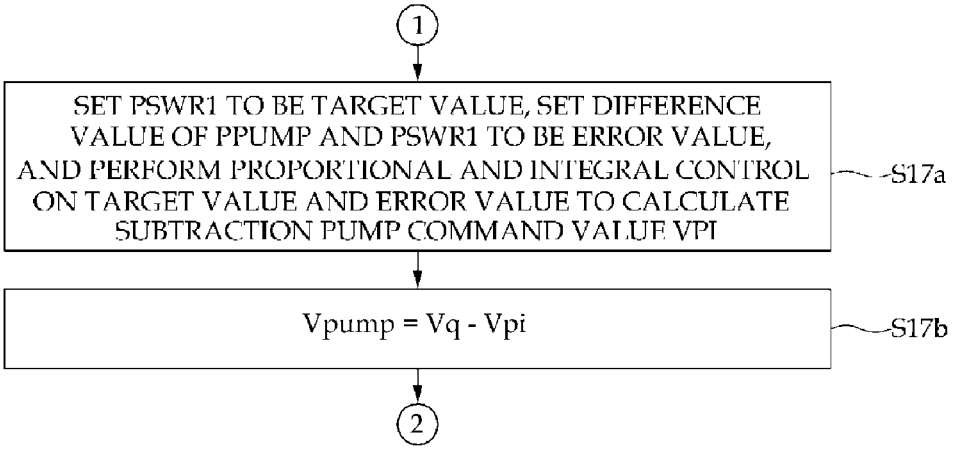
FIG. 5 is a flow chart of embodying period ①-② of FIG. 4.

Step 17 will be described in more detail with reference to FIG. 5. The proportional and integral control is performed by setting the first reference pressure Pswr1 to be the target value and setting the difference value between the discharge pressure Ppump of the hydraulic pump 100 and the first reference pressure Pswr1 to be the error value and thus, the subtraction command value Vpi is calculated (S17*a*). Thereafter, the pump command value Vpump input to the regulator 101 is calculated by subtracting the subtraction command value Vpi from the pump command value Vq corresponding to the converted swing operation quantity Vsw' (S17*b*). That is, since the subtraction command value Vpi is changed according to the difference between the first reference pressure Pswr1 and the discharge pressure Ppump of the hydraulic pump 100 and is gradually increased over time, the pump command value Vpump may be gradually reduced so that the discharge pressure Ppump of the hydraulic pump 100 is lower than the first reference pressure Pswr1.

After performing S18, the control unit 150 ends the proportional and integral control only when it is determined that the discharge pressure Ppump of the hydraulic pump 100 is lower than the second reference pressure Pswr2 by the comparison result of the discharge pressure Ppump of the hydraulic pump 100 with the second reference pressure Pswr2. The reason is that when the proportional and integral control ends based on the first reference pressure Pswr1, the pump command value Vpump according to the swing operation quantity Vsw is calculated from the table Tsp and thus, may be increased exceeding the first reference pressure Pswr1 again. However, when the proportional and integral control ends based on the second reference pressure Pswr2 lower than the first reference pressure Pswr1, the swing speed of the swing motor 120 is increased for the time in which the discharge pressure Ppump of the hydraulic pump 100 falls to the second reference pressure Pswr2 by the proportional and integral control, thereby increasing the flux consumed by the swing motor 120. Therefore, the discharge pressure Ppump is not increased even thought the flux of the hydraulic pump 100 is increased by inputting the pump command value Vq corresponding to the swing operation quantity Vsw to the regulator 101.

Figure 6:
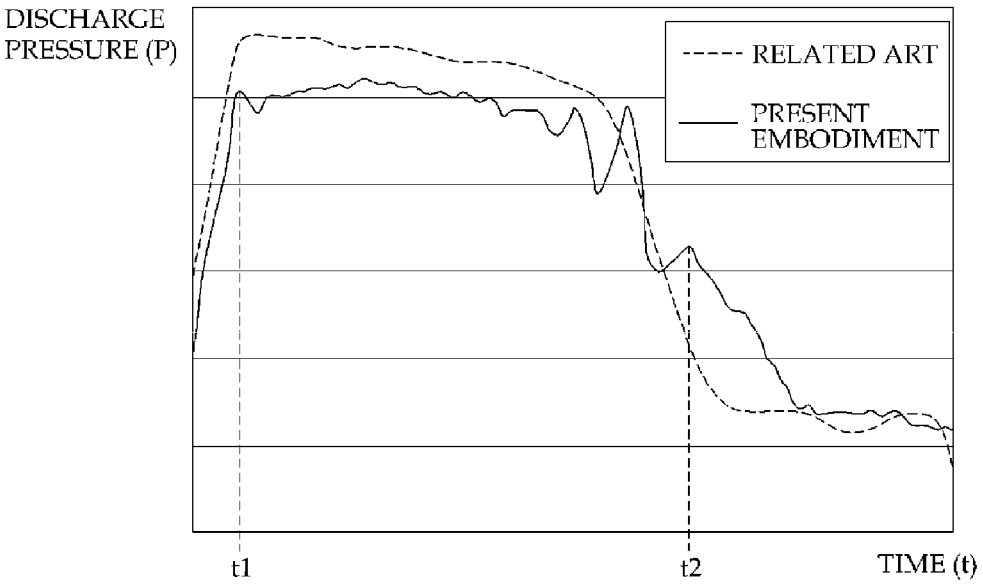
FIG. 6 is a graph for schematically showing a discharge pressure diagram of the hydraulic pump according to the exemplary embodiment of the present disclosure and a discharge pressure diagram of the hydraulic pump according to the related art.
Figure 7:
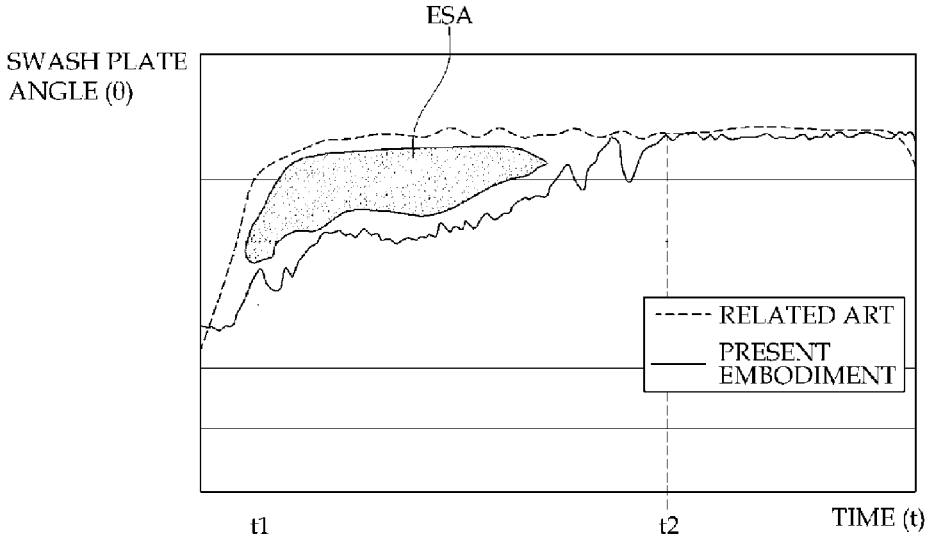
FIG. 7 is a graph for schematically showing a change diagram in a swash plate angle of the hydraulic pump according to the exemplary embodiment of the present disclosure and a change diagram in a swash plate angle of the hydraulic pump according to the related art.

The graph of the discharge pressure Ppump and the swash plate angle of the hydraulic pump 100 detected by the above-mentioned swing control method is shown in FIGS. 6 and 7. FIGS. 6 and 7 are graphs measuring the discharge pressure Ppump and the swash plate angle of the hydraulic pump 100 while maintaining the state in which the swing operation unit 130 is operated above the reference swing operation quantity Vswo. Referring to this, timing t1 is a point in which the discharge pressure Ppump of the hydraulic pump 100 is the first reference pressure Pswr1 or more. As shown in FIG. 6, it can be appreciated that the discharge pressure Ppump of the hydraulic pump 100 is no more increased at timing t1. On the other hand, it can be appreciated from FIG. 7 that the swash plate angle of the hydraulic pump 100 is continuously increased even at timing t1. That is, since the flux increasing rate of the hydraulic pump 100 is not higher than the increasing rate of the flux required to accelerate the swing motor 120, the discharge pressure Ppump may not be increased even though the discharge flux of the hydraulic pump 100 is increased. As a result, the quantity of working oil drained through the swing relief valve is minimized, such that the loss of power may be minimized.

On the other hand, timing t2 is a point in which the swing speed reaches a normal state. Even though the swash plate angle of the hydraulic pump 100 is maximized, the driving speed of the swing motor 120 is increased and thus, the discharge pressure Ppump of the hydraulic pump 100 falls rather.

The loss of power may be reduced corresponding to a portion of an ESA region as shown in FIG. 7 by the above-mentioned control.

Although the present invention has been described with reference to disclosed embodiments, workers skilled in the art will recognize that changes may be made in form and detail without departing from the spirit and scope of the disclosure. The present disclosure can be applied to construction machinery of which the top swing body can be swung such as an excavator, a backhoe, or the like.

The invention claimed is:

1. A swing control apparatus of construction machinery, comprising:

a hydraulic pump discharging working oil for driving a swing motor and controlling a discharge flux according to an input pump command value Vpump;

a pressure sensor sensing pressure of the working oil discharged from the hydraulic pump; and a control unit calculating the pump command value Vpump based on a swing operation quantity Vsw input from the swing operation unit to output the calculated pump command value to the hydraulic pump, wherein when the input swing operation quantity Vsw is larger than a preset reference swing operation quantity Vswo and the discharge pressure Ppump of the hydraulic pump detected by the pressure sensor is lower than a first reference pressure Pswr1, the control unit calculates a converted swing operation quantity Vsw' gradually increasing from the reference swing operation quantity Vswo to the input swing operation quantity Vsw and calculates the pump command value Vpump of the hydraulic pump corresponding to the converted swing operation quantity Vsw'.

2. The apparatus of claim 1, wherein when the input swing operation quantity Vsw is larger than the reference swing operation quantity Vswo and the discharge pressure Ppump of the hydraulic pump is larger than the first reference pressure Pswr1, the control unit sets the first reference pressure Pswr1 to be a target value and a difference between the first reference pressure Pswr1 and the discharge pressure Ppump of the hydraulic pump to be an error value to perform a proportional and integral control and calculates a pump command value Vpump output by subtracting a subtraction command value Vpi calculated from the proportional and integral control from a pump command value Vq of the hydraulic pump corresponding to the converted swing operation quantity Vsw'.

3. The apparatus of claim 2, wherein the control unit performs the proportional and integral control until the discharge pressure Ppump of the hydraulic pump is below the second reference pressure Pswr2 lower than the first reference pressure Pswr1.

4. A swing control method for construction machinery including a hydraulic pump discharging working oil for driving a swing motor and varying a discharge flux according to a swash plate angle calculated based on an input swing operation amount Vsw, the method comprising:

a) comparing the discharge pressure Ppump of the hydraulic pump with a first reference pressure Pswr1 when the swing operation quantity Vsw is input;

b) when the discharge pressure Ppump of the hydraulic pump is larger than the first reference pressure Pswr1, controlling a swash plate angle of the hydraulic pump so that the discharge pressure Ppump of the hydraulic pump gradually approaches the first reference pressure Pswr1; and c) when the discharge pressure Ppump of the hydraulic pump is below a second reference pressure Pswr2 lower than the first reference pressure Pswr1, stopping a control at step b), and the method further comprising when the input swing operation quantity Vsw is larger than the reference swing operation quantity Vswo, calculating a converted swing operation quantity Vsw' gradually increasing from the reference swing operation quantity Vswo to the input swing operation quantity Vsw for a predetermined time to control the swash plate angle of the hydraulic pump based on the converted swing operation quantity Vsw'.

* * * * *